US006971322B2

(12) United States Patent
DuBois et al.

(10) Patent No.: US 6,971,322 B2
(45) Date of Patent: Dec. 6, 2005

(54) PROTECTIVE ENCLOSURE

(75) Inventors: Clay Allen DuBois, Diamondhead, MS (US); Scott Kenneth Hoelzel, Bay St. Louis, MS (US)

(73) Assignee: Delaware Capital Formation Inc., Wilmington, DE (US)

( * ) Notice: Subject to any disclaimer, the term of this patent is extended or adjusted under 35 U.S.C. 154(b) by 0 days.

(21) Appl. No.: 10/389,393

(22) Filed: Mar. 14, 2003

(65) Prior Publication Data

US 2004/0177794 A1 Sep. 16, 2004

(51) Int. Cl.[7] ..... G07G 5/00

(52) U.S. Cl. ..... 109/24.1; 109/59 T; 312/216; 70/1.5; 70/416

(58) Field of Search ..... 109/24.1, 59 R, 109/59 T, 60, 74; 70/1.5, 109, 416–418; 312/215–221

(56) References Cited

U.S. PATENT DOCUMENTS

| | | | | | |
|---|---|---|---|---|---|
| 393,289 | A | | 11/1886 | Becht | |
| 1,010,365 | A | | 11/1911 | Hensle | |
| 2,086,534 | A | * | 7/1937 | Byrne | 220/811 |
| 3,165,225 | A | * | 1/1965 | Georg | 220/324 |
| 3,175,873 | A | * | 3/1965 | Blomquist et al. | 312/296 |
| 3,819,228 | A | | 6/1974 | Comacchia | |
| 3,893,740 | A | * | 7/1975 | England | 312/216 |
| 4,048,050 | A | * | 9/1977 | Hillman | 206/1.5 |
| 4,158,337 | A | * | 6/1979 | Bahry et al. | 109/59 R |
| 4,266,488 | A | * | 5/1981 | Markham | 109/59 R |
| 4,477,130 | A | * | 10/1984 | Frantz | 312/219 |
| 4,548,330 | A | * | 10/1985 | Hewitt et al. | 220/210 |
| 4,684,035 | A | * | 8/1987 | Hean, Sr. | 220/210 |
| 4,706,577 | A | * | 11/1987 | Jones | 109/59 T |
| 4,725,084 | A | | 2/1988 | Catricola | |
| 4,741,454 | A | | 5/1988 | Ray et al. | |
| 4,754,715 | A | * | 7/1988 | Squires | 109/59 T |
| 4,843,853 | A | | 7/1989 | Bobert et al. | |
| 4,975,680 | A | | 12/1990 | Fogle, Jr. | |
| 5,129,693 | A | | 7/1992 | Schmitt | |
| 5,209,168 | A | * | 5/1993 | Chapron et al. | 109/59 T |
| 5,410,295 | A | | 4/1995 | Van Lint | |
| 5,503,440 | A | * | 4/1996 | Peccoux | 292/158 |
| 5,598,793 | A | | 2/1997 | Lopez, Jr. | |
| 5,784,973 | A | * | 7/1998 | Mercer et al. | 109/59 R |
| 5,845,433 | A | | 12/1998 | Walsh | |
| 5,931,104 | A | * | 8/1999 | Horn et al. | 109/59 R |
| 5,971,515 | A | * | 10/1999 | Baker et al. | 312/329 |
| 6,089,168 | A | * | 7/2000 | Dunlap et al. | 109/59 R |
| 6,293,207 | B1 | * | 9/2001 | Do | 109/59 R |
| 6,561,604 | B2 | * | 5/2003 | Leccia et al. | 312/326 |
| 2002/0062281 | A1 | | 5/2002 | Singhal | |
| 2003/0009426 | A1 | | 1/2003 | Ruiz-Sanchez | |

FOREIGN PATENT DOCUMENTS

| | | |
|---|---|---|
| EP | 0580297 | 11/1993 |
| EP | 0437925 | 1/1996 |
| WO | WO 9960502 | 11/1999 |

OTHER PUBLICATIONS

Ky. Firm Leads Shift to Electronic ATM Locks . . . , Journal Name-American Baker, Sep. 16, 1999.

(Continued)

*Primary Examiner*—Suzanne Dino Barrett
(74) *Attorney, Agent, or Firm*—Baker & McKenzie LLP

(57) ABSTRACT

Protective enclosure having at least one anti-pry apparatus. The at least one anti-pry apparatus prevents an unauthorized operator from prying open a door panel from at least one of its sides.

16 Claims, 11 Drawing Sheets

OTHER PUBLICATIONS

Castell, Stephen, Seeking after the truth in computer evidence: Any proof of ATM fraud?, Dec. 1996.
Vandal resistant keypad, Sep. 1, 2002.
Schneider, B., Cyber Crime, Dec. 1997.
Breitrose, C., Fingerprint technology gathers mementum, Aug. 1997.
Kowalski, B., Use of smart cards for security applications by Deutche Telekom, Sep. 1996.
Borowsky, M., TO catch a thief (consumer deposit accounts: fraud and theft), Nov. 1994.
Essinger, J., ATM fraud and the customer, Jun. 1994.
Vand Der Velde, M., Curbing ATM fraud, Apr. 1990.
Burk, H., Pfitzmann, A., Digital payment systems enabling security and unobservability, Aug. 1989.
Q Comm Signs Qxpress POA Dristibution Agreement With Access ATM and Financial Services Authority, Aug. 1, 2002.
Diebold Introduces Triple Data Encryption Standard and Remote Key Transport to Improve Security and Reduce Costs of ATM DES Key Management, Mar. 11, 2002.
No More Passwords of Debit Cards—City Money's New ATM—iTeller—Requires Only Thumb Print or Eye Scan, Mar. 14, 2002.
Humboldt Bancorp Reports Theft Related to ATM Funding Business, Dec. 12, 2001.
North Communications Inc. and AmStar Systems Inc. Join Forces to Add Functionality to the ATM, Jan. 30, 2001.
McDonald's Contracts with Diebold for ATM Placements, Sep. 26, 2000.

* cited by examiner

PROTECTIVE ENCLOSURE

FIELD

The present application relates to a protective enclosure and, more particularly, to an enclosure that prevents an unauthorized operator from prying open the door.

BACKGROUND

Enclosures, such as automated teller machines, are well known in the prior art for protecting valuable items stored within the interior. The valuable items may include, cash, checks, jewelry or the like. Unauthorized operators sometimes attack these enclosures by prying around the enclosure door. Hence, passive locking mechanisms are used with the enclosures. Passive locking mechanisms rely on the strength of the steel or other material to prevent distortion to the enclosure in the event of prying by the unauthorized operator. Due to the increased thickness of the steel or other material used to construct these enclosures, the enclosures are heavier and have higher associated costs.

A need exists, however, for an enclosure having one or more active anti-pry apparatuses that prevent an unauthorized operator from prying open the door panel and thereby obtaining access to the interior.

SUMMARY

An aspect of the present application provides for an apparatus for securing a door panel to a protective enclosure during prying by an unauthorized operator. The apparatus comprises a plurality of slots, and a plurality of tabs, each of the plurality of tabs being operable for engaging the respective plurality of slots when an edge of the door panel is pried by the unauthorized operator at a point along the plurality of tabs.

Another aspect of the present application provides for a protective enclosure. The protective enclosure comprises a housing structure having a back wall panel, a bottom panel, a top wall panel and surrounding sidewall panels to define an interior, the housing structure having an open front area for allowing access into the interior, an upper horizontal security member located in the interior and including a plurality of upper slots, a door panel operable for enclosing the interior of the housing structure by being positioned across the front area to define a closed position, the door panel including a plurality of upper tabs, each of the plurality of upper tabs being operable for engaging the respective plurality of upper slots when a downward force is exerted on the top edge of the door panel, and a hinge member for attaching the door panel to one of the side walls.

A further aspect of the present application provides for an apparatus for securing a door to a protective enclosure during prying by an unauthorized operator, comprising a horizontal security member including a plurality of slots, the horizontal security member being attached to the interior of the protective enclosure, and a plurality of tabs connected to or integrated into the door, each of the plurality of tabs being operable for engaging the respective plurality of slots when the door is pried at a point along the plurality of tabs.

A still further aspect of the present application provides for an apparatus for securing a door panel to a protective enclosure during prying by an unauthorized operator. The apparatus comprises a plurality of slots, each of the plurality of slots including an anti-pry notch portion, and a plurality of fingers, the plurality of fingers engaging and disengaging the plurality of respective slots, in normal operation, and at least one of the plurality of fingers being forced into at least one of the respective anti-pry notch portions when an edge of the door panel is pried by the unauthorized operator at a point along the plurality of fingers.

An additional aspect of the present application provides for a protective enclosure. The protective enclosure comprises a housing structure having a back wall panel, a bottom panel, a top wall and surrounding sidewall panels to define an interior, the housing structure having an open front area for allowing access into the interior, an inner flange of one of the side wall panels including a plurality of slots, each of the plurality of slots including an anti-pry notch portion, a door panel having a first side and a second side, the door panel operable for enclosing the interior of the housing structure by being positioned across the front area to define a closed position, a lock bar movably connected to the first side of the door panel and including a plurality of fingers, the lock bar operable for sliding up and down the first side of the door panel to engage and disengage the plurality of fingers and the plurality of respective slots, in normal operation, and at least one of the plurality of fingers being forced into at least one of the respective anti-pry notch portions when a force is exerted on the first side of the door panel, and a hinge member for attaching the second side of the door panel to the other side wall panel.

An aspect of the present application provides for an apparatus for securing a door panel having a first side and a second side to a protective enclosure having side wall panels during prying by an unauthorized operator. The apparatus comprises an inner flange of one of the side wall panels including a plurality of slots, each of the plurality of slots including an anti-pry notch portion, and a lock bar movably connected to the first side of the door panel and including a plurality of fingers, the lock bar operable for sliding up and down the first side of the door panel to engage and disengage the plurality of fingers and the plurality of respective slots, in normal operation, and at least one of the plurality of fingers being forced into at least one of the respective anti-pry notch portions when a force is exerted on the first side of the door panel.

A further aspect of the present application provides for a protective enclosure, comprising a housing structure having a back wall panel, a bottom panel, a top wall panel and surrounding sidewall panels to define an interior, the housing structure having an open front area for allowing access into the interior, an upper horizontal security member located in the interior and including a plurality of upper slots, a door panel having a first side, a second side, a top edge and a bottom edge, the door panel operable for enclosing the interior of the housing structure by being positioned across the front area to define a closed position, the door panel including a plurality of upper tabs, each of the plurality of upper tabs being operable for engaging the respective plurality of upper slots when a downward force is exerted on the top edge of the door panel, an inner flange of one of the side wall panels including a plurality of slots, each of the plurality of slots including an anti-pry notch portion, a lock bar movably connected to the first side of the door panel and including a plurality of fingers, the lock bar operable for sliding up and down the first side of the door panel to engage and disengage the plurality of fingers and the plurality of respective slots, in normal operation, and at least one of the plurality of fingers being forced into at least one of the respective anti-pry notch portions when a force is exerted on the first side of the door, and a hinge member for attaching the second side of the door panel to one of the side walls.

DETAILED DESCRIPTION

Figure 1:
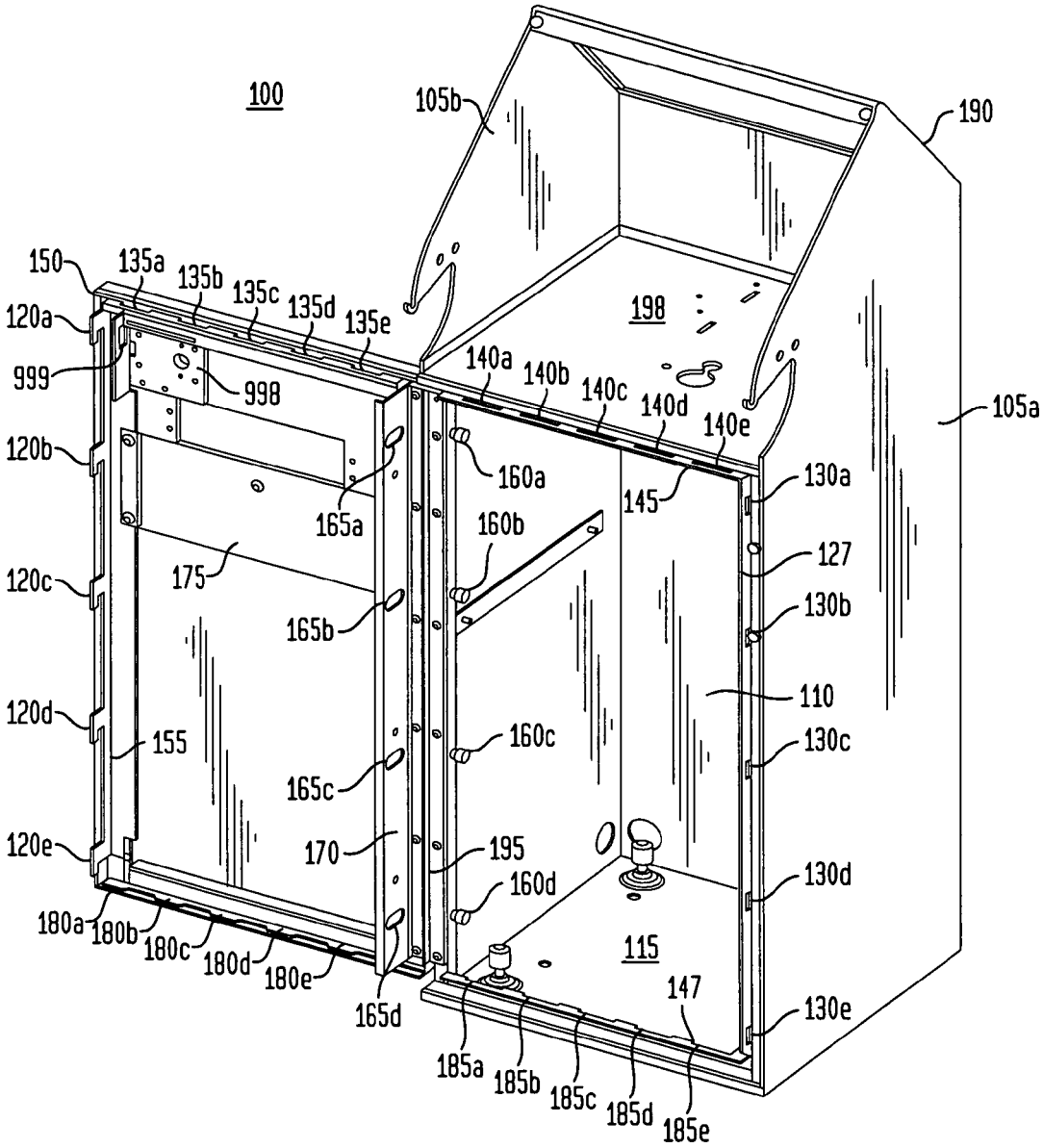
FIG. 1 illustrates an exemplary protective enclosure according to the present application.

FIG. 1 illustrates an exemplary protective enclosure 100 according to the present application. Protective enclosure 100 is operable as a safe or lock box and/or can be used as an automatic teller machine ("ATM") or the like. Protective enclosure 100 may also be operable to automatically dispense its contents, such as with an ATM. The exemplary embodiments described herein secure the contents of protective enclosure 100, for instance, by preventing an unauthorized operator from prying open door panel 150. The size and shape of protective enclosure 100, and the proportions of its respective components, depicted in FIG. 1 are merely illustrative.

Protective enclosure 100 includes housing structure 190 having back wall panel 110, bottom panel 115, top panel 198 and surrounding sidewall panels 105*a*, 105*b* to define an interior. As can be seen in FIG. 1, housing structure 190 has an open front area for allowing access into the interior. Protective enclosure 100 also includes door panel 150 operable for enclosing the interior of housing structure 190 by being positioned across the front area to define a closed position. FIG. 1 illustrates door panel 150 in an open position. Door panel 150 is pivotally attached to housing structure 190 by hinge member 195. Housing structure 190 and door panel 150 are not limited to any particular size or shape.

Protective enclosure 100 includes an anti-pry apparatus along the top and/or bottom of door panel 150 and housing structure 190. In particular, protective enclosure 100 includes upper horizontal security member 145 and lower horizontal security member 147. Alternatively, protective enclosure 100 includes either upper horizontal security member 145 or lower horizontal security member 147. Upper horizontal security member 145 and lower horizontal security member 147 can be attached to top panel 195 and bottom panel 115, respectively, or top panel 195 and bottom panel 115, and upper horizontal security member 145 and lower horizontal security member 147, respectively, can be constructed as single components.

In an exemplary embodiment, upper horizontal security member 145 and lower horizontal security member 147 include at least one slot. FIG. 1, for instance, illustrates five slots 140*a* . . . 140*e* in upper horizontal security member 145 and five slots 185*a* . . . 185*e* in lower horizontal security member 147. Door panel 150 includes a plurality of corresponding upper tabs 135*a* . . . 135*e* and a plurality of corresponding lower tabs 180*a* . . . 180*e*. Each of the plurality of upper tabs 135*a* . . . 135*e* and each of the plurality of lower tabs 180*a* . . . 180*e* are operable for engaging each of the respective upper slots 140*a* . . . 140*e* and each of the respective lower slots 185*a* . . . 185*e* only when the top and the bottom of door panel 150 are pried with a prying device. In normal operation, however, the plurality of upper tabs 135*a* . . . 135*e* and the plurality of lower tabs 180*a* . . . 180*e* are not engaged with the respective slots. Similar to the upper horizontal security member 145 and lower horizontal security member 147, the plurality of upper tabs 135*a* . . . 135*e* and the plurality of lower tabs 180*a* . . . 180*e* can be attached to door panel 150 or integrated into door panel 150. The functioning of the plurality of upper slots 140*a* . . . 140*e* and the plurality of lower slots 185*a* . . . 185*e*, and the corresponding upper tabs 135*a* . . . 135*e* and corresponding lower tabs 180*a* . . . 180*e*, are described below in more detail with reference, for example, to FIGS. 2 and 6.

In an alternative embodiment of the present application, housing structure 190 includes the plurality of upper tabs 135*a* . . . 135*e* and/or the plurality of lower tabs 180*a* . . . 180*e* and door panel 150 includes the plurality of corresponding upper slots 140*a* . . . 140*e* and/or the plurality of corresponding lower slots 185*a* . . . 185*e*, respectively.

Further, the anti-pry apparatus can be located on at least one side of protective enclosure 100 so that the anti-pry apparatus prevents door panel 150 from being pried open from at least one of the sides of door panel 150. Accordingly, the anti-pry apparatus can be used for preventing prying attempts at any of four sides of door panel 150.

Protective enclosure 100 also includes an anti-pry apparatus along the corner where side panel 105*a* meets door panel 150. Protective enclosure 100 includes inner flange 127 along side wall panel 105*a*. Inner flange 127 has a plurality of slots 130*a* . . . 130*e*, each of the plurality of slots 130*a* . . . 130*e* including an anti-pry notch portion 405 shown in FIG. 4. Inner flange 127 can be attached to side wall panel 105*a* or integrated into side wall panel 105*a*.

Figure 7:
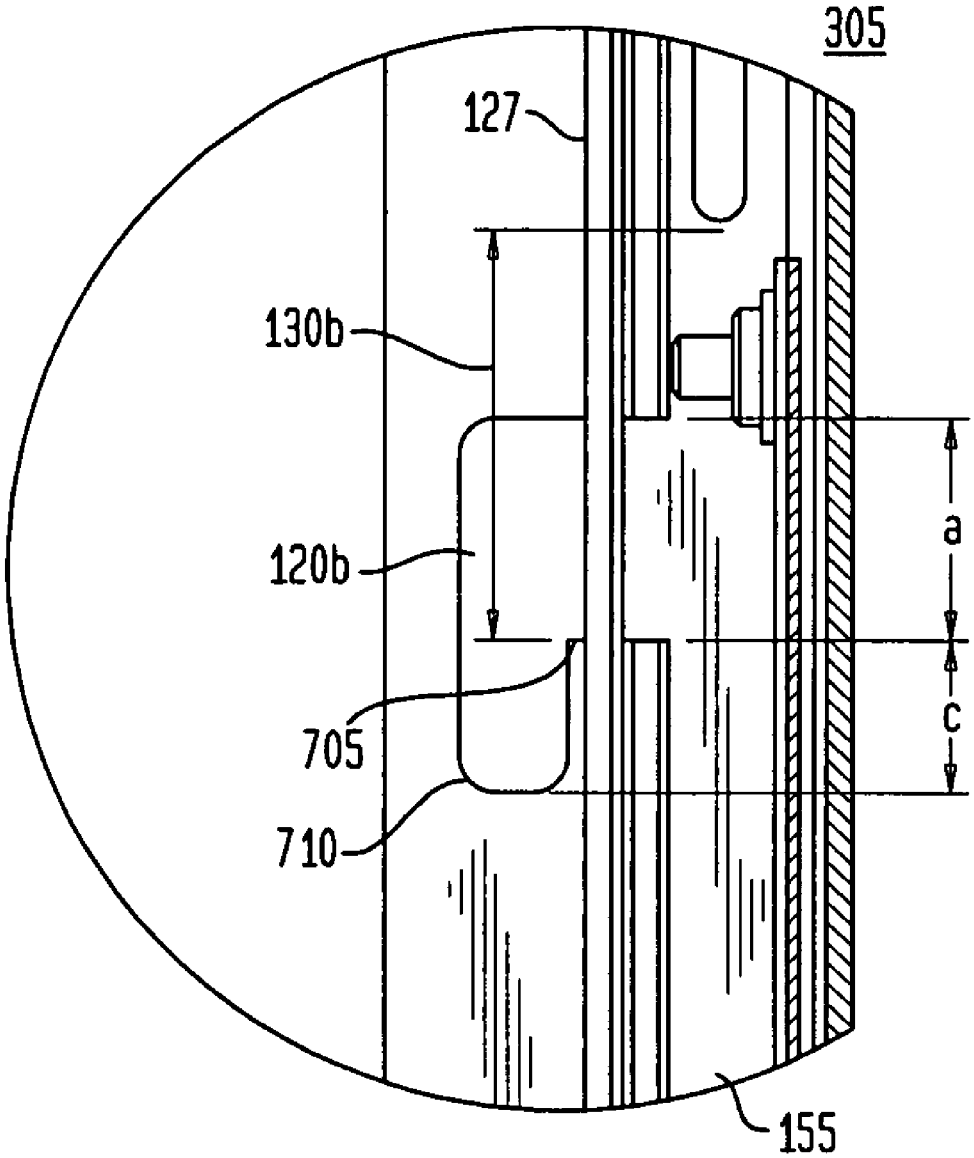
FIG. 7 illustrates a cross sectional view of an exemplary inner flange and an exemplary lock bar having a finger.
Figure 8:
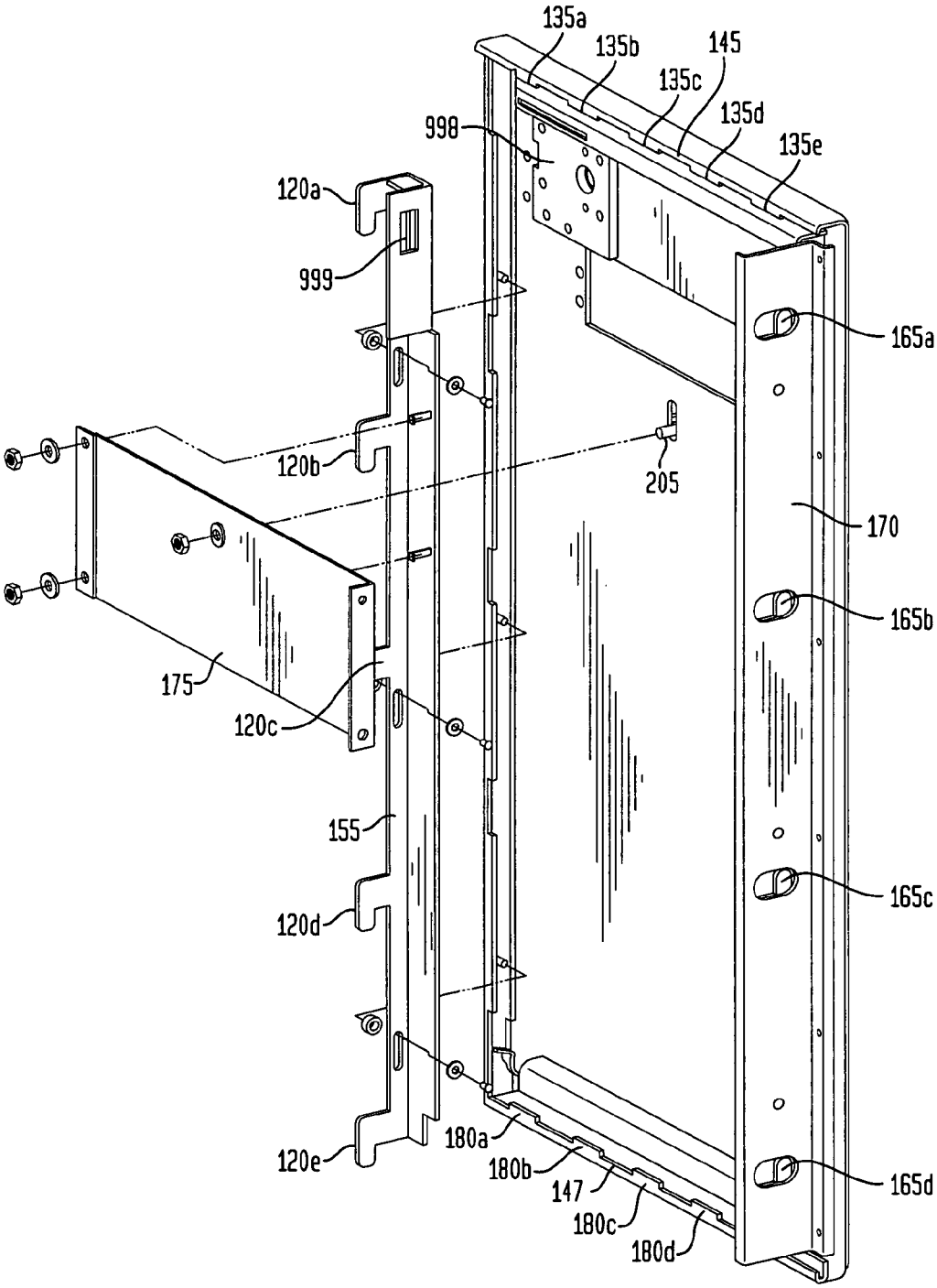
FIG. 8 illustrates an exploded view of an exemplary door panel of the protective enclosure shown in FIG. 1.

A side portion of door panel 150 has attached thereto lock bar 155. Lock bar 155 includes a plurality of fingers 120*a* . . . 120*e*, each of the plurality of fingers 120*a* . . . 120*e* operable for engaging each of the respective plurality of slots 130*a* . . . 130*e*. Lock bar 155 is movably connected to the side portion of door panel 150, as shown in FIG. 8. Specifically, lock bar 155 is operable for sliding up and down the side portion within the interior of housing structure 190, in normal operation. The functioning of the plurality of slots 130*a* . . . 130*e* and the plurality of corresponding fingers 120*a* . . . 120*e* are described below in detail with reference to, for example, FIGS. 3, 4 and 7.

In an alternative embodiment of the present application, housing structure 190 includes the plurality of fingers 120*a* . . . 120*e* and lock bar 155 movably attached to door panel 150 includes the plurality of slots 130*a* . . . 130*e*.

Further, the anti-pry apparatus can be located on the top, the bottom and/or the other side of housing structure 190 and door panel 150 so that the anti-pry apparatus prevents door panel 150 from being pried open. Accordingly, the anti-pry apparatus can be used for preventing prying attempts at any of four sides of door panel 150.

Additionally, protective enclosure includes an anti-pry apparatus along the corner where door panel 150 meets side panel 105*b*, that is, the hinged corner of protective enclosure 100. Door panel 150 includes lock bar 505 having a plurality of l-shaped slots 165*a* . . . 165*d*. Lock bar 505 is movably attached to vertical member 170, vertical member 170 being firmly attached to the side of door panel 150 adjacent hinge member 195. Lock bar 505 is operable for sliding up and down within the interior of housing structure 190. Housing structure 190 includes a plurality of bolts 160*a* . . . 160*d* protruding from a front portion of side wall panel 105*b* into the interior, each of the plurality of bolts 160*a* . . . 160*d* aligning with the plurality of respective l-shaped slots 165*a* . . . 165*d*. The functioning of the plurality of l-shaped slots 165*a* . . . 165*d* and the plurality of corresponding bolts 160*a* . . . 160*d* are described below in detail with reference to, for example, FIGS. 2 and 5.

Figure 9:
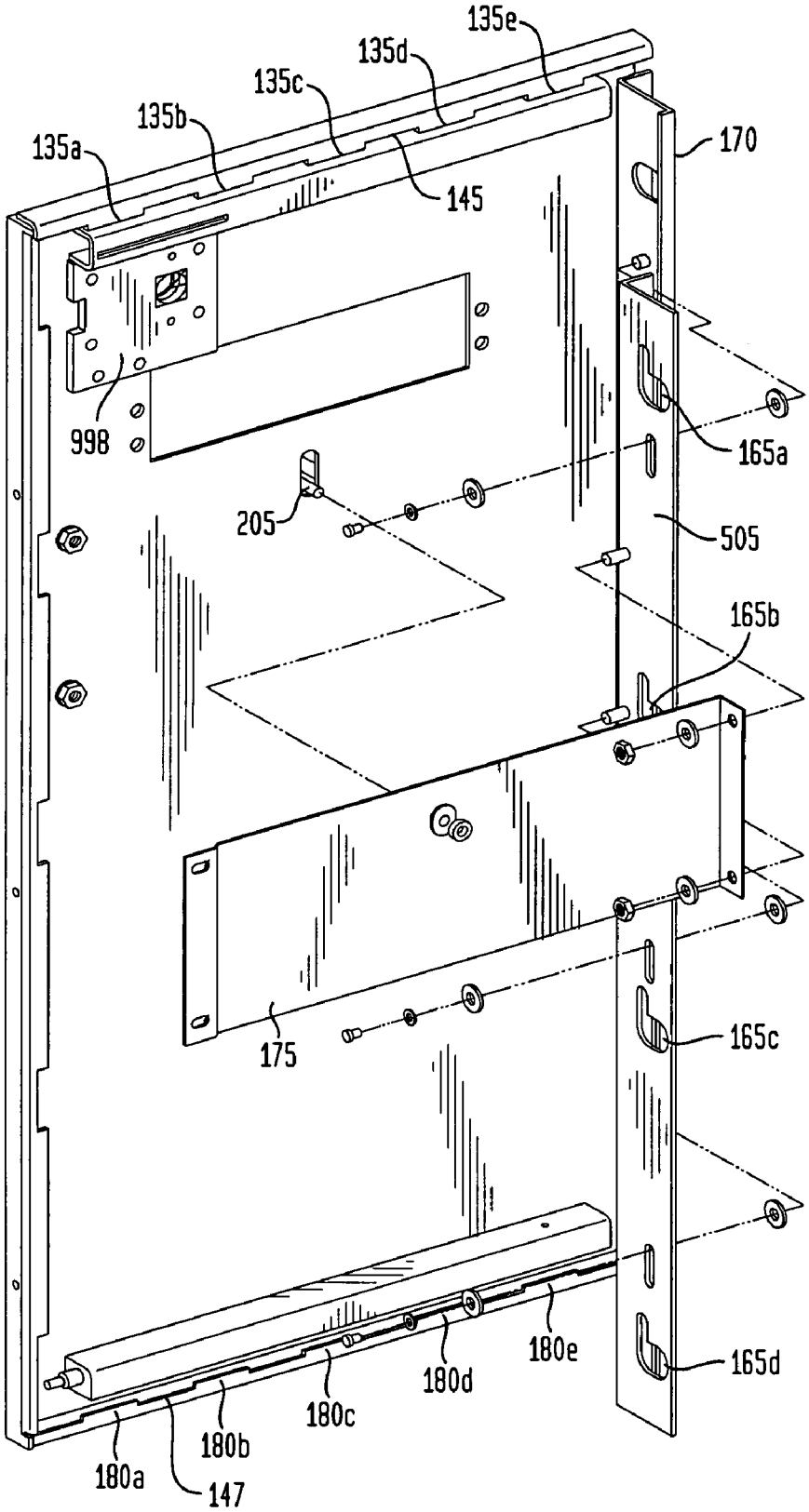
FIG. 9 illustrates another exploded view of the exemplary door panel of the protective enclosure shown in FIG. 1.

Lock bar 155 and lock bar 505 are connected to each other by cross member 175, and latch knob 205 is connected to cross member 175, as shown in FIGS. 1, 8 and 9. In an exemplary embodiment, a portion of latch knob 205 protrudes through door panel 150. An authorized operator can raise and lower lock bar 155 and lock bar 505 using latch knob 205 connected to cross member 175. Further, the activation of a door locking mechanism is controlled by latch knob 205. As described above, latch knob 205 is attached to sliding lock bars, 155, 505 through cross member 175. A deadbolt combination lock is mounted to lock mounting plate 998 using, for instance, high strength bolts. To unlock door panel 150, the deadbolt combination lock is first opened by sliding a deadbolt out of deadbolt slot 999 located on lock bar 155. Latch knob 205 can then be lifted thereby lifting cross member 175 and lock bars 155, 505. With latch knob 205 in the up position, door panel 150 can be pulled open.

The active anti-pry apparatuses described herein are operable so that any prying force is used against an unauthorized operator. When prying door panel 150, the unauthorized operator is hampered by door panel 150 distorting and interlocking with features around housing structure 190. The active anti-pry apparatuses prevent even the slightest prying attempt by causing the interlocking features between housing structure 190 and door panel 150 to mate and thereby preventing door panel 150 from opening.

Figure 2:
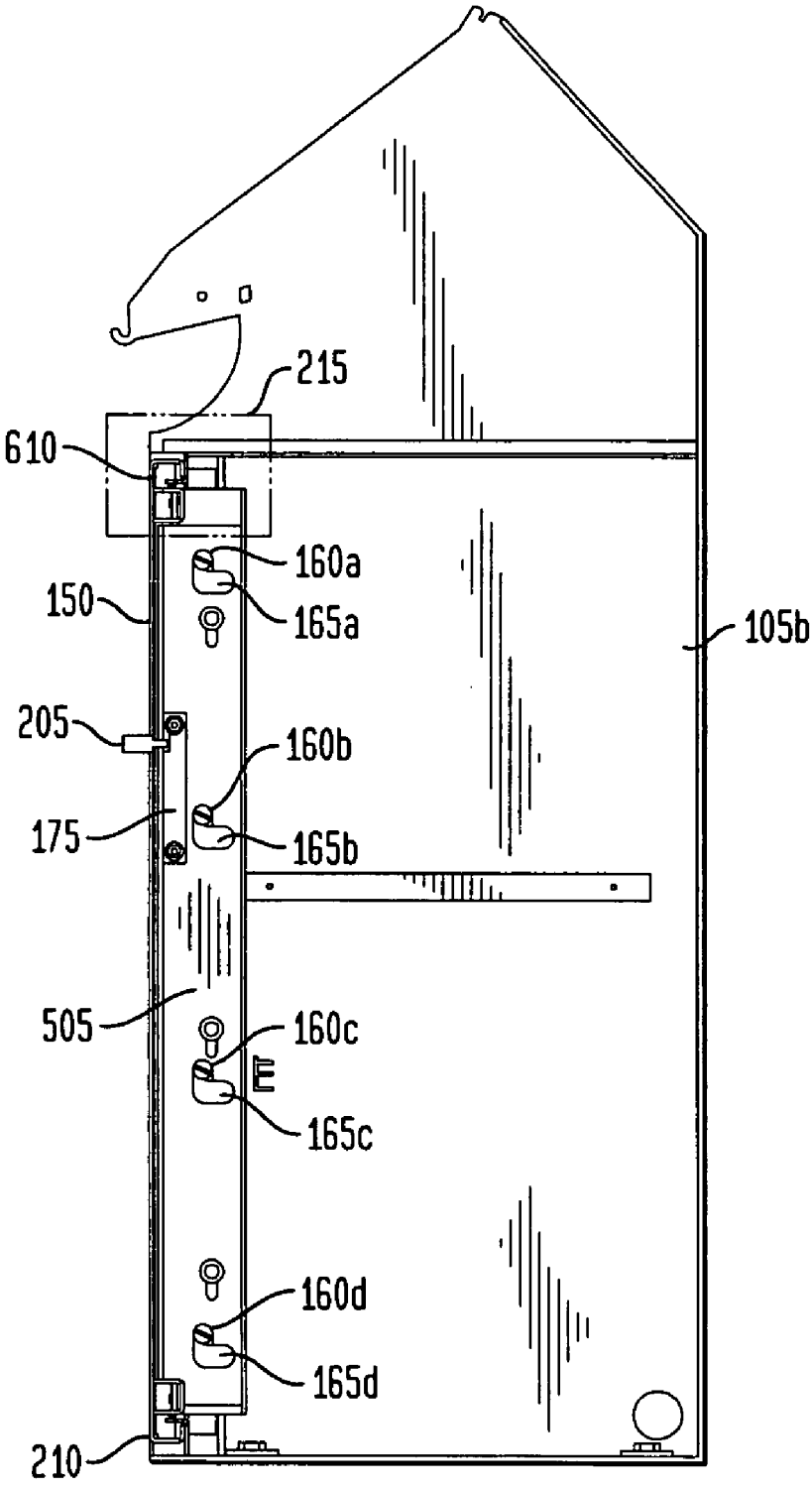
FIG. 2 illustrates a cross sectional view of the protective enclosure shown in FIG. 1.
Figure 3:
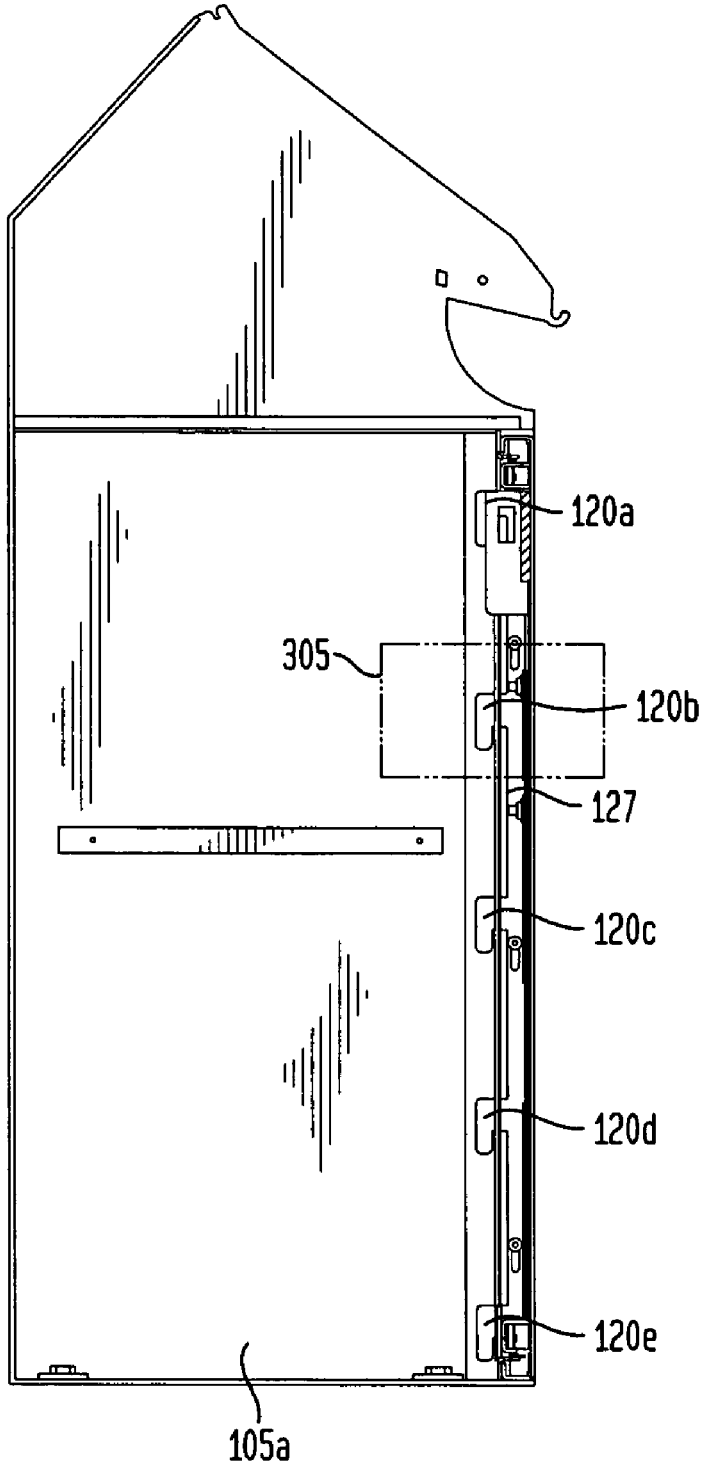
FIG. 3 illustrates another cross sectional view of the protective enclosure shown in FIG. 1.
Figure 6:
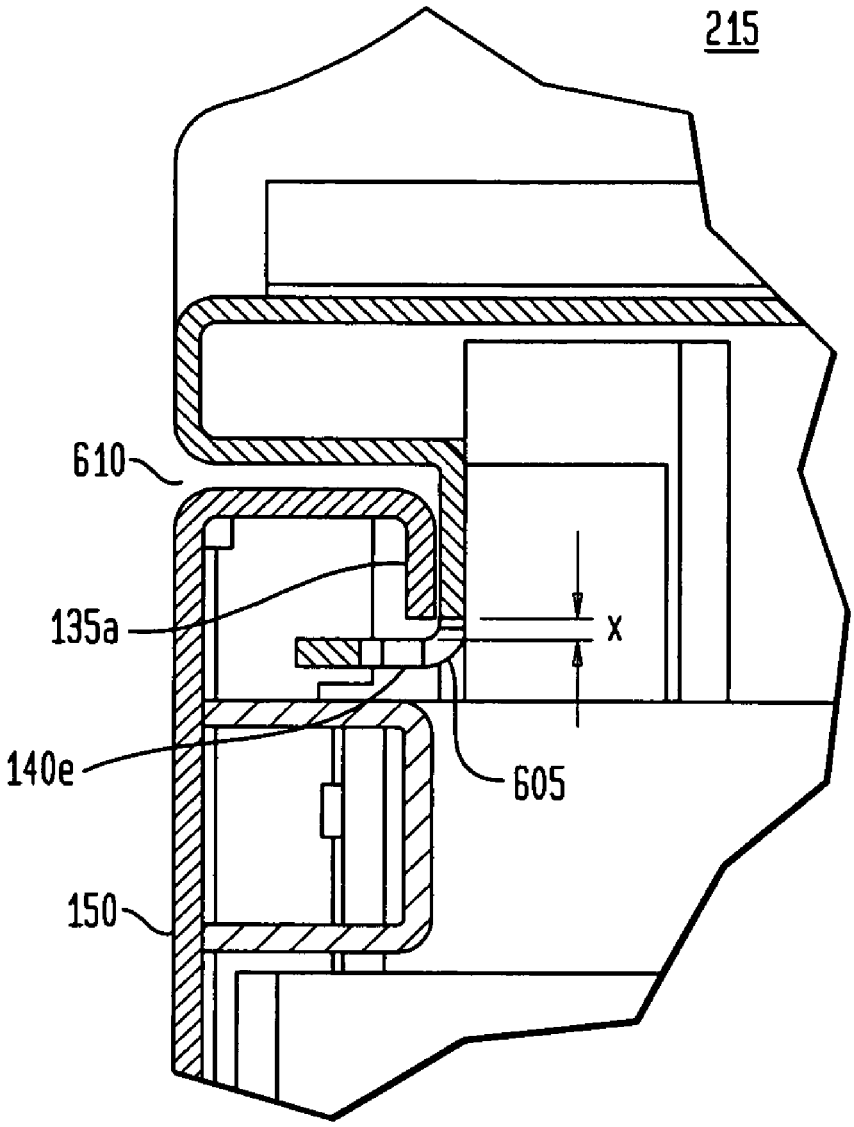
FIG. 6 illustrates a cross sectional view of an exemplary horizontal member and an exemplary tab according to the present application.

In an exemplary embodiment, protective enclosure 100 prevents an unauthorized operator from prying door panel 150 open from the top edge and/or bottom edge of door panel 150. FIGS. 2, 3 and 6, for instance, illustrate the interaction between the plurality of upper slots 140*a* . . . 140*e* and the plurality of lower slots 185*a* . . . 185*e*, and the plurality of corresponding upper tabs 135*a* . . . 135*e* and the plurality of corresponding lower tabs 180*a* . . . 180*e*, respectively, when door panel 150 is in the closed position. FIG. 6 actually depicts the interaction between one of the plurality of upper slots 140*e* and one of the corresponding tabs 135*a*. In an exemplary embodiment, tab 135 is integrated into door panel 150, as shown in FIG. 6. Alternatively, the plurality of upper tabs 135*a* . . . 135*e* and/or the plurality of lower tabs 180*a* . . . 180*e* can be associated with members, not shown in the drawings, that are securely attached to door panel 150. Since each of the slots and respective tabs operate in the same manner, only one tab and corresponding slot are described herein.

In normal operation, tab 135*a* resides above slot 140*e* by a distance x so that door panel 150 can be opened and closed upon demand using latch knob 205 to raise and lower, respectively, cross member 175. Distance x is not meant to be limited to any particular distance.

Tab 135*a* engages slot 140*e* only when an unauthorized operator inserts and uses a prying device in spacing 610, shown in FIGS. 2 and 6. FIG. 2 also illustrates spacing 210 between the plurality of lower slots 185*a* . . . 185*e* and the plurality of corresponding lower tabs 180*a* . . . 180*e*. Specifically, when the unauthorized operator attempts to pry open door panel 150 above tab 135*a* or in close proximity to tab 135*a*, at least tab 135*a* is forced downward and makes contact with elbow 605. Depending on the location of the prying device along spacing 610, one or more other tabs may also be engaged with the respective slot(s). As a result of making contact with elbow 605 and the continuing force applied by the prying device, tab 135*a* continues downward and engages slot 140*e*. Alternatively, tab 135*a* resides directly above slot 140*e* so that elbow 605 is not included. Thus, door panel 150 cannot be pried open since tab 135*a* engages slot 140*e*. In an exemplary embodiment of the present application, once the prying attempt is ceased, tab 135*a* again clears the top of slot 140*e* so that door panel 150 can be opened in the proper manner, for example, by using latch knob 205. Alternatively, tab 135*a* remains lodged in slot 140*e* even after the prying attempt is ceased.

Similarly, if a prying device is inserted in another location along spacing 610, or spacing 210, at least one of the other upper tabs 135*a* . . . 135*e*, or at least one of the other lower tabs 180*a* . . . 180*e*, engage with the respective one or more of the upper slots 140*a* . . . 140*e* and lower slots 185*a* . . . 185*e*, respectively. As described above, the tab(s) below or above the prying device or in close proximity to the prying device engage with the respective slot(s).

Protective enclosure 100 also prevents an unauthorized operator from prying open door panel 150 along its side opposite hinge member 195. This anti-pry apparatus is described below with reference to, for example, FIGS. 3, 4 and 7. FIGS. 4 and 7, however, depict only one of the plurality of fingers 120*a* . . . 120*e*, that is, finger 120*b*, and only one of the plurality of slots 130*a* . . . 130*e*, that is, corresponding slot 130*b*. Each of the other fingers 120*a* . . . 120*e* and each of the other corresponding slots 130*a* . . . 130*e* operate in the same manner and therefore are not described herein.

In normal operation, the plurality of fingers 120*a* . . . 120*e* engage and disengage the corresponding plurality of slots 130*a* . . . 130*e* to prevent and allow, respectively, entry into the interior of housing structure 190. In order to prevent entry into the interior, finger 120*b* of lock bar 155 engages slot 130*b* along inner flange 127, as shown in FIG. 7. When engaged, the bottom 710 of finger 120*b* is lower than the bottom of slot 130*b*. Further, lip 705 of finger 120*b* rests on the bottom, right side portion of slot 130*b*. FIG. 4 illustrates that finger 120*b* resides in the bottom, right side portion of slot 130*b* adjacent anti-pry notch portion 405. Accordingly, door panel 150 cannot be opened due to the bottom 710 of finger 120*b* being lower than the bottom of slot 130*b*.

Lock bar 155 having fingers 120*a* . . . 120*e* is operable for sliding up and down within the interior of housing structure 190, in normal operation, for instance, by using latch knob 205, a portion of which protrudes through door panel 150. Level 205 is operable for raising and lowering cross member 175 and lock bar 155 attached thereto thereby also raising and lowering finger 120*b*. As described herein, latch knob 205 is also operable for raising and lowering lock bar 505 in conjunction with lock bar 155 due to the two lock bars being connected by cross member 175.

In order to open door panel 150, finger 120*b* has to be disengaged. In particular, latch knob 205 is operable so that cross member 175 causes lock bar 155 to raise within the interior. When the bottom 710 of finger 120*b* clears the bottom of slot 130*b*, door panel 150 can be opened by the authorized operator. Conversely, in order to close door panel 150, while finger 120*b* is in the raised position, door panel 150 is closed so that finger 120*b* is inserted into slot 130*b*. Thereafter, level 205 is operated so to lower finger 120*b* in order to engage finger 120*b* and slot 130*b*. Lip 705 of finger 120*b* rests on the bottom, right side portion of slot 130*b*. As a result, door panel 150 is securely closed.

Figure 4A:
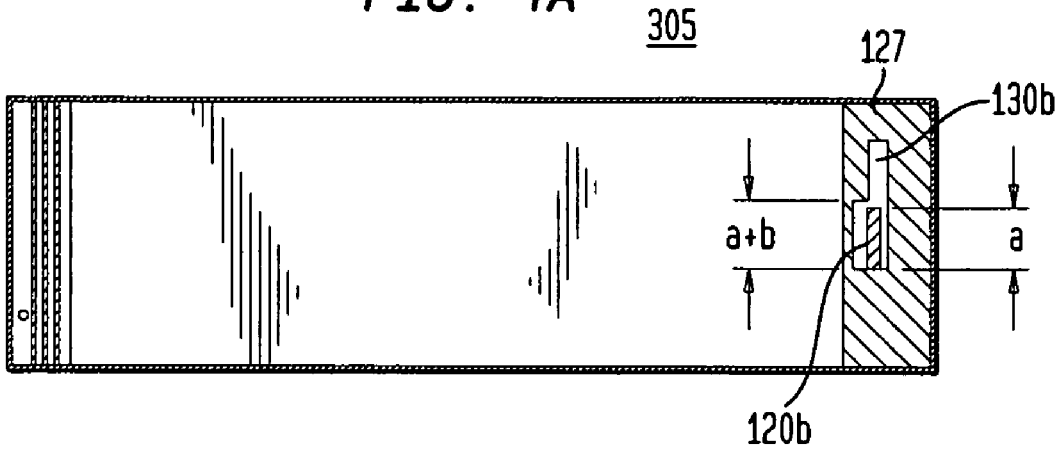
FIG. 4*a* illustrates a cross sectional view of an exemplary inner flange and an exemplary slot during normal operation.
Figure 4B:
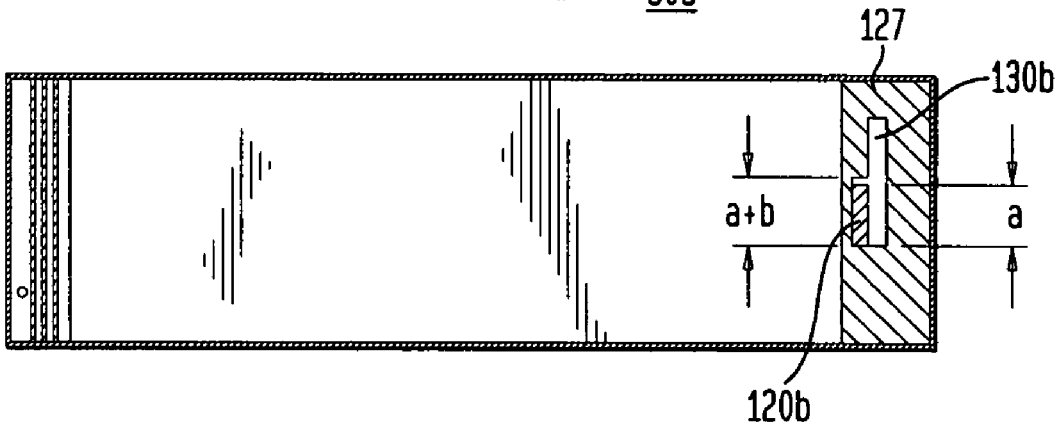
FIG. 4*b* illustrates a cross sectional view of the exemplary inner flange and the exemplary slot upon prying.
Figure 10:
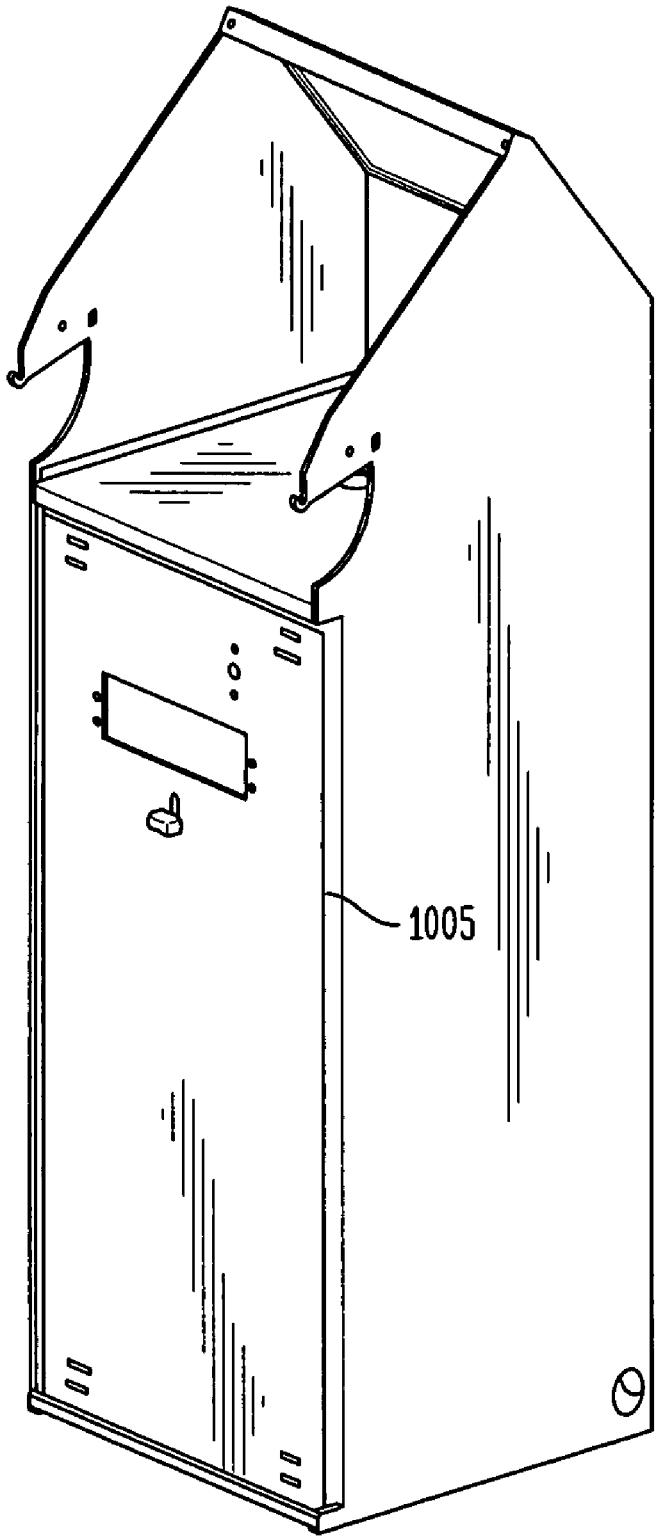
FIG. 10 illustrates a spacing between an exemplary door panel and an exemplary housing structure.
Figure 11:
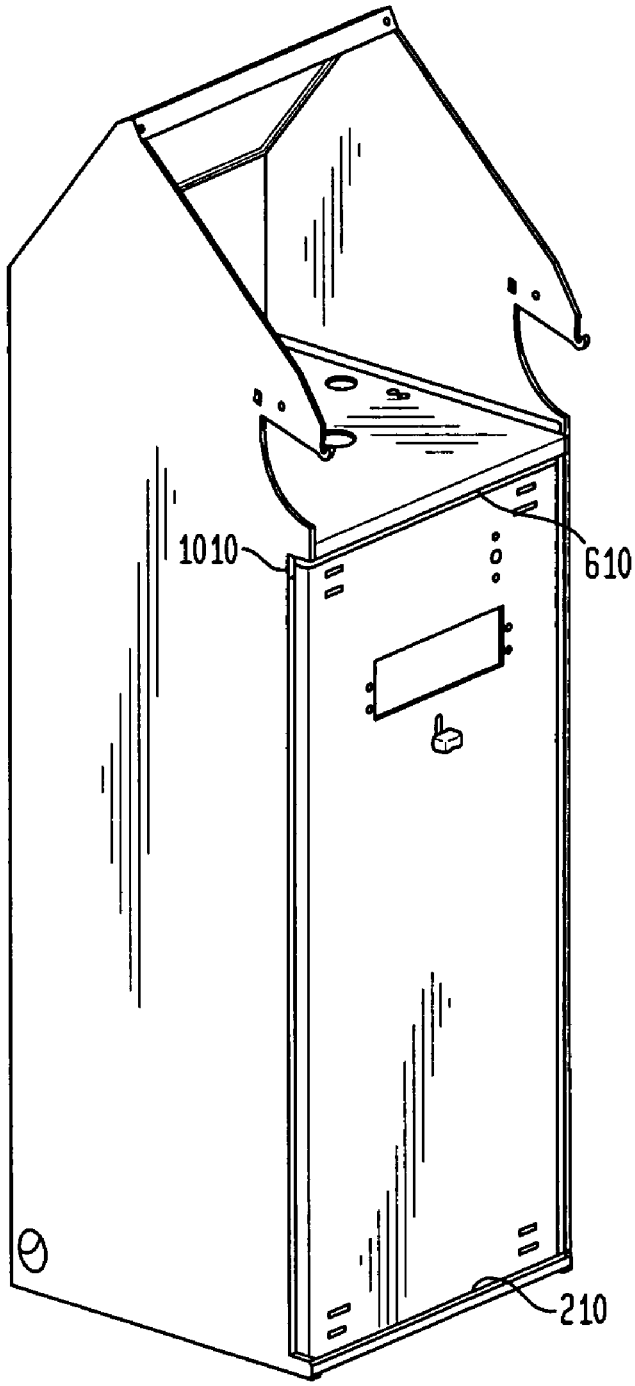
FIG. 11 illustrates additional spacings between the exemplary door panel and the exemplary housing structure.

The anti-pry apparatus including finger 120*b* operates as follows when an unauthorized operator attempts to pry open door panel 150 along that side. The unauthorized operator inserts a prying device in spacing 1005 between a side of door panel 150 and side panel 105*a*. Spacing 1005, and spacings 210, 610, 1010 are illustrated in FIGS. 10 and 11. When the prying device is used, at least one of the plurality of fingers 120*a* . . . 120*e* is forced into the respective anti-pry notch portion(s) 405 due to the force of the prying device. For instance, finger 120*b* is forced into anti-pry portion 405 of slot 130*b*, as illustrated in FIG. 4*b*. As can be seen in FIGS. 4*a*, 4*b* and 7, the length (a+b) of anti-pry notch portion 405 is larger than the length (a) of finger 120*b* by length (b). Length (b) is less than length (c) of finger 120*b*. Alternatively, the length of anti-pry notch portion 405 is the same as length (a) of finger 120*b*. Due to these dimensions, finger 120*b* cannot be disengaged from slot 130*b* while finger 120*b* resides in anti-pry notch portion 405. Specifically, bottom 710 of finger 120*b* cannot clear the bottom of slot 130*b*. In an exemplary embodiment, when the prying attempt has ceased, finger 120*b* returns to the bottom right portion of slot 130*b* so that door panel 150 can be opened according to the normal manner of operation, described above. Alternatively, when the prying attempt has ceased, finger 120*b* remains in anti-pry notch portion 405.

Similarly, if an unauthorized operator uses a prying device in another location along the side of door panel 150 opposite hinge member 195, at least one of the plurality of other fingers 130*a* . . . 130*b* is forced into the respective anti-pry notch portion(s) 405 of the other slots 130*a* . . . 130*e*.

Protective enclosure 100 also prevents an unauthorized operator from prying open door panel 150 along its hinged side. Door panel 150 includes lock bar 505 having at least one l-shaped slot. For instance, a side of door panel 150 includes four l-shaped slots 165*a* . . . 165*d*, as shown and described in the present application. Lock bar 505 is movably attached to vertical member 170 that is firmly attached to door panel 150. Lock bar 505 is operable for sliding up and down within the interior of housing structure 190 in conjunction with lock bar 155 due to cross member 175 coupling the two lock bars, 505, 155. Housing structure 190 includes a plurality of bolts 160*a* . . . 160*d* protruding from a front portion of side wall panel 105*b* into the interior, each of the plurality of bolts 160*a* . . . 160*d* aligning with the plurality of respective l-shaped slots 165*a* . . . 165*d* associated with door panel 150. The functioning of the plurality of l-shaped slots 165*a* . . . 165*d* and the plurality of corresponding bolts 160*a* . . . 160*d* is described herein with reference to only one of the slots 165*c* and the corresponding bolt 160*c* since each slot and corresponding bolt operate in the same manner.

Figure 5A:
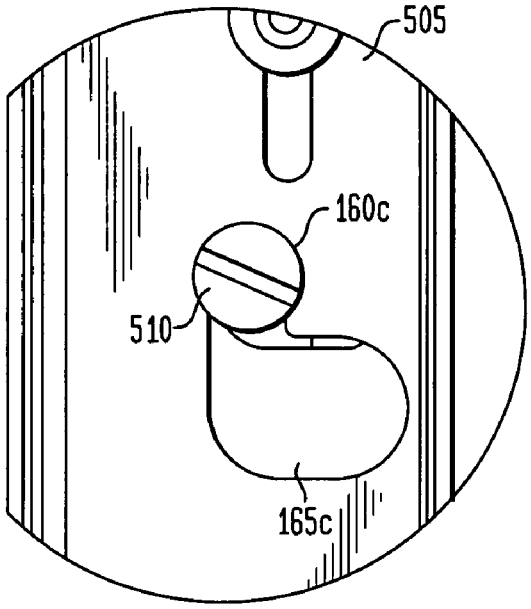
FIG. 5*a* illustrates a cross sectional view of an exemplary lock bar and an exemplary l-shaped slot according to the present application.
Figure 5B:
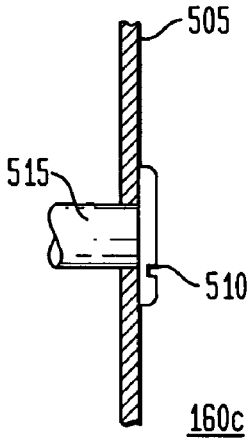
FIG. 5*b* illustrates an exemplary bolt according to the present application.

As can be seen in FIG. 1, bolt 160*c* protrudes into the interior of housing structure 190. In an exemplary embodiment, bolt 160*c* has a head portion 510 and a shaft portion 515 protruding into the interior. The portion of bolt 160*c* protruding into the interior is shown in FIG. 5*b*. The size, shape and type of bolt described and shown in the present application is merely illustrative. Bolt 160*c* mates with l-shaped slot 165*c* located on movable lock bar 505.

If door panel 150 is initially in an open position and an authorized operator wants to close door panel 150, latch knob 205 is operated so that cross member 175 raises lock bar 505 and lock bar 150, assuming lock bars 505, 150 are not already in the proper position. As a result of lock bar 505 raising, slot 165*c* also raises so that bolt 160*c* aligns with the horizontal portion of l-shaped slot 165*c*. FIG. 5*a*, for example, illustrates l-shaped slot 165*c* and, specifically, depicts that the horizontal portion is wider than the top vertical portion of l-shaped slot 165*c*. The authorized operator thereafter closes door panel 150 and head portion 510 of bolt 160*c* passes through slot 165*c*. In particular, head portion 510 resides, for instance, in the left side of the horizontal portion of slot 165*c* when door panel 150 is closed but not yet locked. As shown in FIG. 5*b*, the entire head portion 510 clears lock bar 505. The distance between the back of head portion 510 and lock bar 505 is not limited to a particular amount, for instance, the distance can be greater than or equal to zero.

In order to lock door panel 150, latch knob 205 is operated so that cross member 175 lowers lock bar 505 and lock bar 155. As a result of lock bar 505 lowering, slot 165*c* also lowers so that shaft portion 515 of bolt 160*c* slides into the narrower top vertical portion of l-shaped slot 165*c*. When bolt 160*c* resides in the narrower top vertical portion of l-shaped slot 165*c*, door panel 150 cannot be opened since the back of head portion 510 makes contact with lock bar 505. Accordingly, an unauthorized operator cannot pry open door panel 150 along side panel 150*b* by, for instance, using a prying device in spacing 1010, shown in FIG. 11.

The shape and size of the plurality of l-shaped slots 165*a* . . . 165*d* is merely exemplary. For example, the vertical portion can be located on the right side of the horizontal portion resembling a reversed l-shape. Moreover, shapes other than l-shapes can be used as long as such shapes include a narrower portion. Depending on the shape and location of the slot(s), the bolt(s) may be in the same location as shown in the figures or in different location(s) so that the bolt(s) engage the respective slot(s).

FIGS. 8 and 9 illustrate exploded isometric views of door panel 150 of the protective enclosure according to the present application. In FIGS. 8 and 9, the interaction between and connection of latch knob 205, cross member 175, lock arms 155, 505, vertical member 170, the plurality of slots 135*a* . . . 135*e*, 180*a* . . . 180*e* and the plurality of fingers 120*a* . . . 120*e* are shown.

In an alternative embodiment of the present application, latch knob 205 is operable for lowering lock bar 505 and lock bar 155 in order to disengage door panel 150 from housing enclosure 190 and is operable for raising lock bar 505 and lock bar 155 to engage door panel 150 with housing enclosure 190. As a result, the orientation of the plurality of fingers 120*a* . . . 120*e* and the plurality of corresponding slots 130*a* . . . 130*e*, and the plurality of bolts 160*a* . . . 160*e* and the plurality of corresponding l-shaped slots 165*a* . . .

165*e*, shown in the drawings of the present application are rotated 180 degrees. The anti-pry apparatuses, however, function the same as described herein.

The embodiments described above are illustrative examples of the present application and it should not be construed that the present application is limited to these particular embodiments. Various changes and modifications may be effected by one skilled in the art without departing from the spirit or scope of the invention as defined in the appended claims.

What is claimed is:

1. An apparatus for securing a door panel to a protective enclosure during prying by an unauthorized operator, comprising:

a plurality of slots; and a plurality of tabs disengaged from the plurality of slots when the door panel is in a locked state and in an unlocked state, each of the plurality of tabs being operable for engaging the respective plurality of slots when an edge of the door panel is pried by the unauthorized operator at a point along the plurality of tabs.

2. A protective enclosure, comprising:

a housing structure having a back wall panel, a bottom panel, a top wall panel and surrounding sidewall panels to define an interior, the housing structure having an open front area for allowing access into the interior;

an upper horizontal security member located in the interior and including a plurality of upper slots;

a door panel operable for enclosing the interior of the housing structure by being positioned across the front area to define a closed position, the door panel including a plurality of upper tabs disengaged from the plurality of upper slots when the door panel is in a locked state and in an unlocked state, each of the plurality of upper tabs being operable for engaging the respective plurality of upper slots when a downward force is exerted on the top edge of the door panel; and a hinge member for attaching the door panel to one of the side walls.

3. The protective enclosure as set forth in claim 2, further comprising:

a lower horizontal security member located in the interior and including a plurality of lower slots; and the door panel including a plurality of lower tabs, each of the plurality of lower tabs being operable for engaging the respective plurality of lower slots when an upward force is exerted on the bottom edge of the door panel.

4. The protective enclosure as set forth in claim 2, wherein the upper horizontal security member is connected to the side wall panels.

5. The protective enclosure as set forth in claim 3, wherein the lower horizontal security member is connected to the side wall panels.

6. The protective enclosure as set forth in claim 2, wherein the housing structure is operable as an automated teller machine.

7. An apparatus for securing a door to a protective enclosure during prying by an unauthorized operator, comprising:

a horizontal security member including a plurality of slots, the horizontal security member being attached to the interior of the protective enclosure; and a plurality of tabs connected to or integrated into the door and disengaged from the plurality of slots when the door is in a locked state and in an unlocked state, each of the plurality of tabs being operable for engaging the respective plurality of slots when the door is pried at a point along the plurality of tabs.

8. An apparatus for securing a door panel to a protective enclosure during prying by an unauthorized operator, comprising:

a plurality of slots, each of the plurality of slots including an antipry notch portion; and a plurality of fingers, the plurality of fingers engaging and disengaging the plurality of respective slots when the door panel is in a locked state and in an unlocked state, respectively, and at least one of the plurality of fingers being forced into at least one of the respective antipry notch portions when an edge of the door panel is pried by the unauthorized operator at a point along the plurality of fingers.

9. A protective enclosure, comprising:

a housing structure having a back wall panel, a bottom panel, a top wall and surrounding sidewall panels to define an interior, the housing structure having an open front area for allowing access into the interior;

an inner flange of one of the side wall panels including a plurality of slots, each of the plurality of slots including an anti-pry notch portion;

a door panel having a first side and a second side, the door panel operable for enclosing the interior of the housing structure by being positioned across the front area to define a closed position;

a lock bar movably connected to the first side of the door panel and including a plurality of fingers, the lock bar operable for sliding up and down the first side of the door panel to engage and disengage the plurality of fingers and the plurality of respective slots when the door panel is in a locked state and in an unlocked state, respectively, and at least one of the plurality of fingers being forced into at least one of the respective antipry notch portions when the door panel is pried by an unauthorized operator on the first side of the door panel; and a hinge member for attaching the second side of the door panel to the other side wall panel.

10. The protective enclosure as set forth in claim 9, wherein the housing structure is operable as an automated teller machine.

11. An apparatus for securing a door panel having a first side and a second side to a protective enclosure having side wall panels during prying by an unauthorized operator, comprising:

an inner flange of one of the side wall panels including a plurality of slots, each of the plurality of slots including an anti-pry notch portion; and a lock bar movably connected to the first side of the door panel and including a plurality of fingers, the lock bar operable for sliding up and down the first side of the door panel to engage and disengage the plurality of fingers and the plurality of respective slots when the door panel is in a locked state and in an unlocked state, respectively, and at least one of the plurality of fingers being, forced into at least one of the respective anti-pry notch portions when the door panel is pried by an unauthorized operator on the first side of the door panel.

12. A protective enclosure, comprising:

a housing structure having a back wall panel, a bottom panel, a top wall panel and surrounding sidewall panels to define an interior, the housing structure having an open front area for allowing access into the interior;

an upper horizontal security member located in the interior and including a plurality of upper slots;

a door panel having a first side, a second side, a top edge and a bottom edge, the door panel operable for enclosing the interior of the housing structure by being positioned across the front area to define a closed position, the door panel including a plurality of upper tabs disengaged from the plurality of upper slots when the door panel is in a locked state and in an unlocked state, each of the plurality of upper tabs being operable for engaging the respective plurality of upper slots when a downward force is exerted on the top edge of the door panel;

an inner flange of one of the side wall panels including a plurality of slots, each of the plurality of slots including an anti-pry notch portion;

a lock bar movably connected to the first side of the door panel and including a plurality of fingers, the lock bar operable for sliding up and down the first side of the door panel to engage and disengage the plurality of fingers and the plurality of respective slots when the door panel is in a locked state and in an unlocked state, respectively, and at least one of the plurality of fingers being forced into at least one of the respective anti-pry notch portions when the door panel is pried by an unauthorized operator on the first side of the door; and a hinge member for attaching the second side of the door panel to one of the side walls.

13. The apparatus as set forth in claim 8, wherein the plurality of slots are l-shaped.

14. The protective enclosure as set forth in claim 9, wherein the plurality of slots are l-shaped.

15. The apparatus as set forth in claim 11, wherein the plurality of slots are l-shaped.

16. The protective enclosure as set forth in claim 12, wherein the plurality of slots are l-shaped.

* * * * *